United States Patent [19]

Chen

[11] 4,048,683

[45] Sept. 20, 1977

[54] SPACE-SAVING FOLDING BED

[76] Inventor: Tiyung Chen, No. 33, She-tzu 9th Street, Shihlin District, Taipei, China

[21] Appl. No.: 528,718

[22] Filed: Dec. 2, 1974

[51] Int. Cl.[2] ..... A47C 19/12

[52] U.S. Cl. ..... 5/180; 5/174

[58] Field of Search ..... 5/110, 111, 112, 113, 5/114, 174, 175–178, 179, 180

[56] References Cited

U.S. PATENT DOCUMENTS

| | | | |
|---|---|---|---|
| 3,004,623 | 10/1961 | Nissen | 5/111 |
| 3,077,612 | 2/1963 | Sevcik | 5/111 X |
| 3,602,927 | 9/1971 | Wyss | 5/111 |
| 3,619,827 | 11/1971 | Mackenzie | 5/111 |
| 3,840,912 | 10/1974 | Fischer | 5/111 |

FOREIGN PATENT DOCUMENTS

| | | | |
|---|---|---|---|
| 643,530 | 2/1964 | Belgium | 5/174 |
| 1,311,408 | 10/1962 | France | 5/178 |
| 861,371 | 2/1941 | France | 5/174 |
| 1,104,137 | 9/1953 | Germany | 5/177 |

*Primary Examiner*—Paul R. Gilliam
*Assistant Examiner*—David H. Corbin
*Attorney, Agent, or Firm*—Holman & Stern

[57] ABSTRACT

This invention relates to folding beds and aims at correcting certain shortcomings of all other folding beds. The invention contains the mechanism of a Space-saving Folding Bed the legs of which at both ends automatically unfold when the bed is unfolded for use, and also automatically fold onto the frame when the bed is folded up.

5 Claims, 10 Drawing Figures

Fig. I
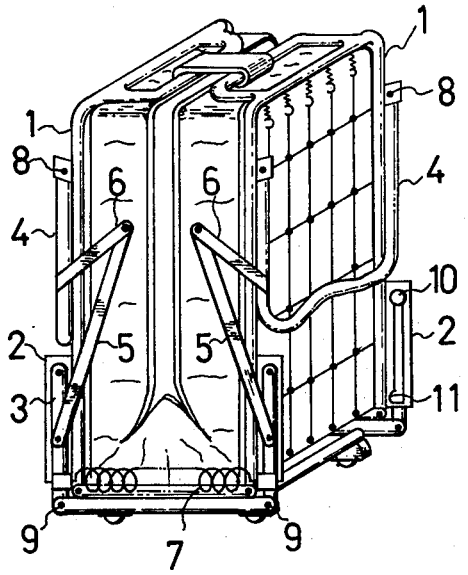
Fig. 2
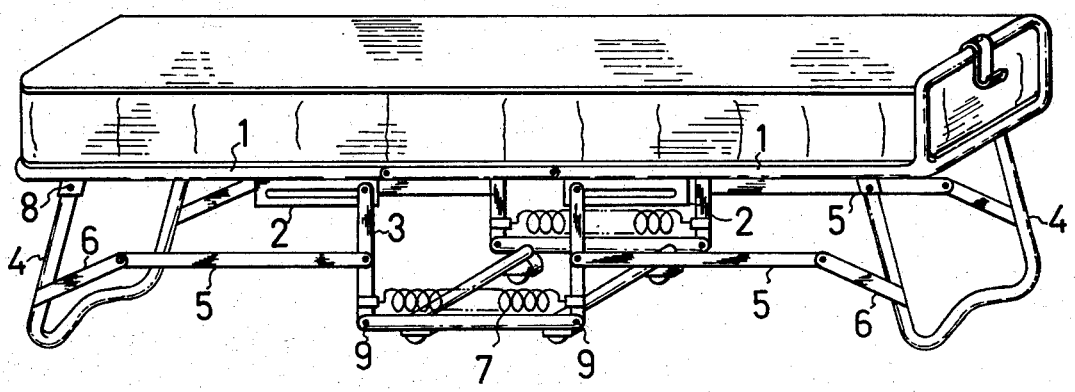

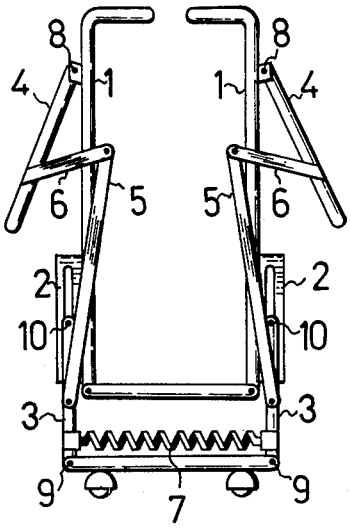
Fig. 5
Fig. 6
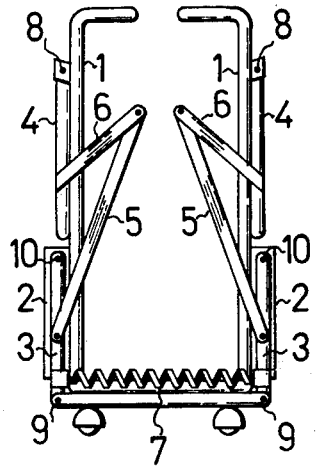
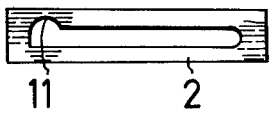
Fig. 7

SPACE-SAVING FOLDING BED

BRIEF SUMMARY OF THE INVENTION

The characteristic feature of this invention is that the legs at both ends of the bed automatically fold onto the frame when the bed is folded up, and that the whole frame of the bed, when folded, may be lowered down between the legs at the middle section of the bed. On account of these improvements, this newly invented Space-saving Folding Bed is very practical, space saving, and convenient at times of moving. We just push the both ends of the bed frame outward, the whole bed will be automatically getting ready for use immediately.

BRIEF DESCRIPTION OF THE SEVERAL VIEWS OF THE DRAWING

FIG. 1 View of bed folded

FIG. 2 View of bed unfolded

FIG. 5 Line sketch of both ends when the bed is folded up to vertical position.

FIG. 6 Line sketch of frame of bed lowered down

FIG. 7 Outline form of slide rail with fixing dent

DETAILED DESCRIPTION

Figure 3:
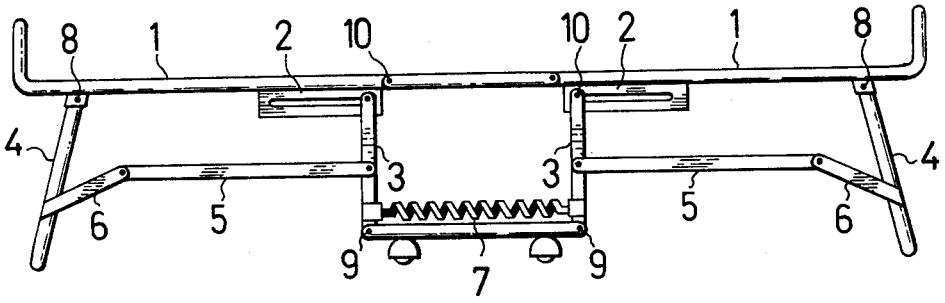
FIG. 3 Line sketch of frame of bed when unfolded

Commercially available folding beds may in general be devided into two kinds. Each of these two kinds is convenient in one but inconvenient in another respect. The first kind does not occupy much space, but its legs do not automatically fold onto the frame, which causes inconvenience. The other kind has legs that fold automatically, but the legs of the middle section of the bed cannot be folded, shortened, or lowered, which means that a considerable space is still wasted. To correct these shortcomings and provide improvements for living conditions, the present invention presents the construction of a Space-saving Folding Bed the legs of which at both ends automatically fold onto the frame when the bed is folded and the frame of which, after being folded, can be lowered down very near to the ground. It is convenient and space saving. When it is unlatched at the top, a spring automatically unfolds and puts down the legs and both ends of the bed.

In the following, the invention is described with reference to the attached drawings.

The invention consists of the following component parts: base of bed 1; slide rails, 2; bed legs under the middle section 3; legs at both ends of the bed 4; connecting rod 5; fixed-angle (approx. 75°–78°) extension rod 6 attached to both bed ends spring 7; turn joints between base of bed and legs at both ends 8 (when bed unfolded, base of bed and bed legs form an angle of 100°); turn joints of legs under the middle section of bed 9 (these legs and base of bed are always in a rectangular position); slide pin 10.

Figure 4:
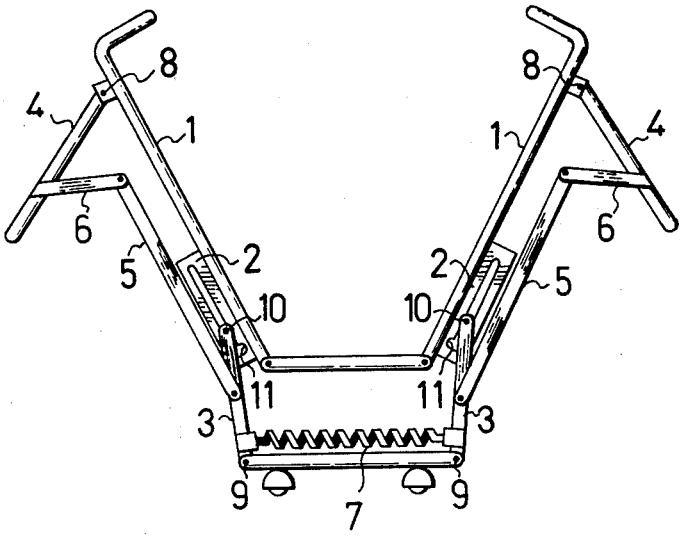
FIG. 4 Line sketch of bed half folded
Figure 8:
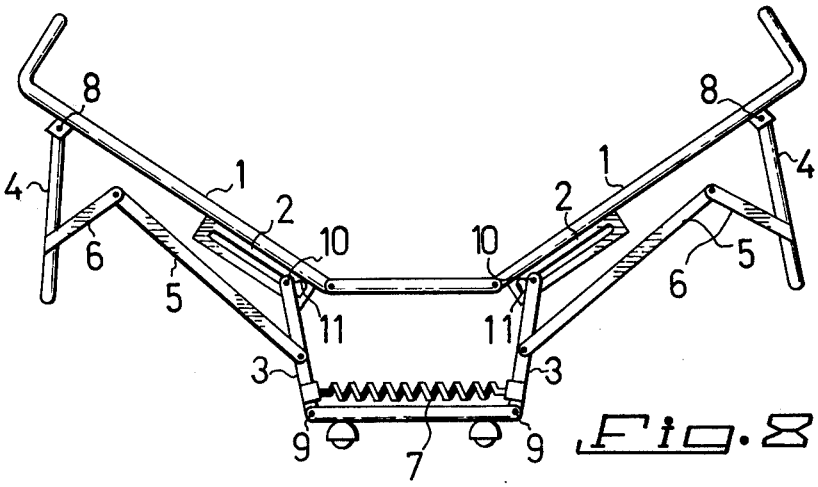
FIG. 8 illustrates the opening of the base of the bed to some angle.
Figure 9:
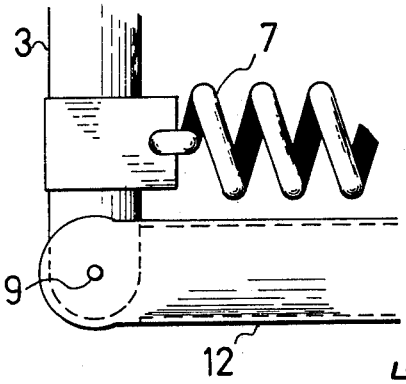
FIG. 9, is a further illustration of one embodiment of the base of the bed.
Figure 10:
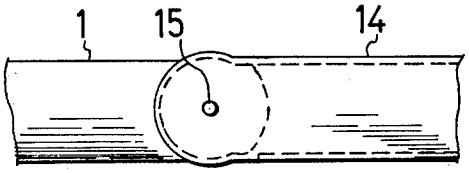
FIG. 10, is an illustration of one embodiment of the turn joint.

FIG. 3 shows the relative position of the component parts of Space-saving Folding Bed when unfolded. When the two halves of base of bed 1 are folded upward, as shown in FIG. 4, because then the angle formed between connecting rod 5 and extension rod 6 is less than 180°, the legs at both ends of the bed 4 fold inward, not outward. When the bed is folded to a near vertical position, as shown in FIG. 5, the position of slide rail 2 is changed, the slide pin 10 is moved slightly upward, and the bed legs at both ends 4 are folded further inward. When the bed is folded to a completely vertical position, as shown in FIG. 6, the frame of the bed slides, by its own weight, down between the legs under the middle section 3. In this position, even if the legs under the middle section 3 were pulled apart, the spring 7 would pull the legs 3 back to the original rectangular position. The force of the spring 7 holds the frame of the bed in a fixed position, and the same force keeps the connecting rod 5 and the legs at both ends of the bed 4 in the proper position when the bed is unfolded. Also, when the slide pin 10 has slid into the fixing dent 11 at the end of the slide rail 2, the whole middle section of the bed is kept in a firm and steady position. FIG. 8 is a further view showing the operative relationship between the various portions of the folding bed on the opening angle begins to exceed 45 degrees. The action of the spring between the two vertical portions of the U-shaped legs tends to pull the legs together forcing the middle section upwardly due to the caming action of slide pin 10 immediately prior to its sliding into fixing dent 11. FIG. 9 is a closer view of the pivotal turn joint of the U-shaped legs forming the bed base. FIG. 10 is illustrative of pivotally connecting the vertical extending legs with the middle section of the bed frame.

FIG. 9 is a closer view of the pivotal turn joint 9 connecting legs 3 and base 12 of the U-shaped legs forming the bed base. FIG. 10 is illustrative of pivotally connecting 15 the vertical extending legs 1 with the middle section 14 of the bed frame.

Changes in details may be made without departing from the spirit or scope of the invention; but,

I claim as my invention:

1. In a space saving folding bed having a middle frame section supported by a plurality of generally U-shaped rotatable legs, each of said legs comprised of a horizontal portion with generally vertical extending portions pivotally connected to each end of said horizontal portion, said extending portion terminating in an upper end, said bed having frame end portions movable between a horizontal and vertical position, each of said end portions being pivotally connected to said middle frame section, said improvement comprising;

spring means for biasing each of said vertically extending portions of said rotatable legs, towards each other in said horizontal and vertical positions; and connecting means for allowing a slidable connection, in a direction parallel to said frame end portions, between said upper end of said U-shaped legs and said frame end portion and for permitting said frame end portion and said middle frame section to be slidably lowered to said horizontal portion of said generally U-shaped legs when said frame end portions are in a near vertical position.

2. The apparatus in claim 1, wherein said connecting means comprises:

an extending pin located on the upper end of each of said U-shaped legs; and slot means for defining an elongated aperture along each of said frame end portions, said extending pin cooperating with said slot means permitting movement parallel to said frame end portion.

3. The apparatus of claim 1, wherein said space saving folding bed further comprises leg means for supporting said frame end portions, said improvement further comprising retracting means, responsive to said vertically extending portion of said U-shaped legs, for maintaining said leg means in a vertical position when said frame end portions are in said vertical position.

4. The apparatus of claim 2, wherein said slot means further comprises a detent means for holding said extending pin against travel along said slot means when said frame end portions are in said horizontal position.

5. The apparatus of claim 3, wherein said retracting means comprises:

an angular extension fixably connected at one end to said leg means; and an extension rod pivotally connected at one end to said other end of said angular extension, the other end of said extension rod pivotally connected to said vertical extending portion of said U-shaped legs.

* * * * *